US006220936B1

(12) United States Patent
Quek

(10) Patent No.: US 6,220,936 B1
(45) Date of Patent: Apr. 24, 2001

(54) IN-SITE ROLLER DRESSER

(75) Inventor: Ser Wee Quek, Singapore (SG)

(73) Assignees: Chartered Semiconductor Manufacturing Ltd., Singapore (SG); Lucent Technologies, Allentown, PA (US)

( * ) Notice: Subject to any disclaimer, the term of this patent is extended or adjusted under 35 U.S.C. 154(b) by 0 days.

(21) Appl. No.: 09/206,734

(22) Filed: Dec. 7, 1998

(51) Int. Cl.[7] ..... B24B 29/00; B24B 1/00

(52) U.S. Cl. ..... 451/41; 451/285; 451/287; 451/56; 451/443

(58) Field of Search ..... 451/56, 443, 444, 451/41, 285, 287, 288

(56) References Cited

U.S. PATENT DOCUMENTS

| | | | |
|---|---|---|---|
| 5,421,768 | 6/1995 | Fujiwara et al. | 451/283 |
| 5,681,212 | 10/1997 | Hayakawa et al. | 451/288 |
| 5,688,360 | 11/1997 | Jairath | 156/345 |
| 5,775,983 | 7/1998 | Shendon et al. | 451/444 |
| 5,779,526 | 7/1998 | Gill | 451/324 |
| 5,885,147 * | 3/1999 | Kreager et al. | 451/56 |
| 5,944,585 * | 8/1999 | Nagahara et al. | 451/56 |
| 5,961,373 * | 10/1999 | Lai et al. | 451/444 |
| 5,997,385 * | 12/1999 | Nishio | 451/56 |

* cited by examiner

*Primary Examiner*—Eileen P. Morgan
(74) *Attorney, Agent, or Firm*—George O. Saile; Rosemary L. S. Pike

(57) ABSTRACT

The invention teaches an in-site roller dresser that allows for the profile of the polishing pad to be monitored while the roller is dressed or refurbished. This eliminates the need for destructive testing of the polishing pad. The in-site roller dresser at the same time eliminates the need for machine downtime for polishing pad profile determination since the polishing pad profile is dynamically tested and monitored during polishing operations. In conventional arrangements, the dresser is a disk, in the arrangement of the present invention the dresser is a roller type that can rotate around its axis in either direction. A sensor is provided with the diamond dresser that monitors the surface or profile of the polishing pad. Based on the data obtained by the sensor, the diamond dresser can be adjusted which directly controls the polishing pad refurbishing action provided by the dresser.

36 Claims, 1 Drawing Sheet

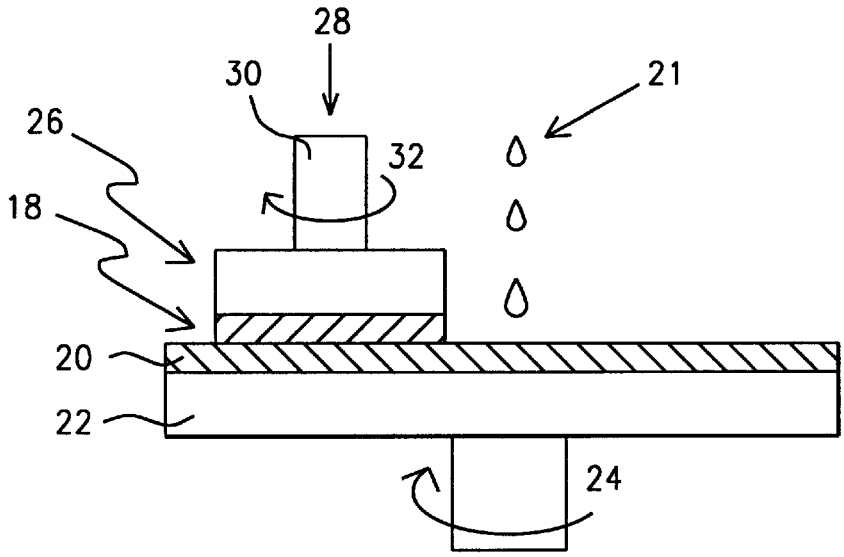
FIG. 1 – Prior Art
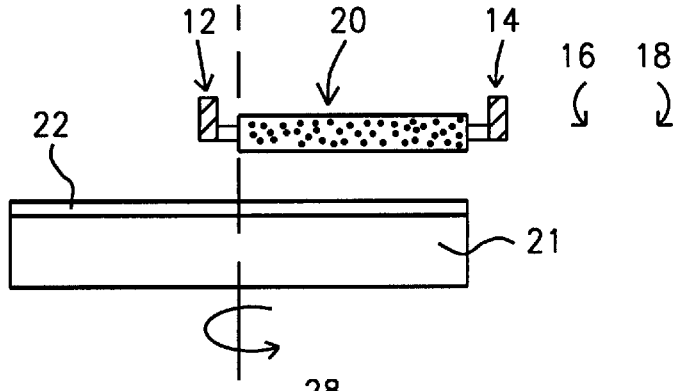
FIG. 2
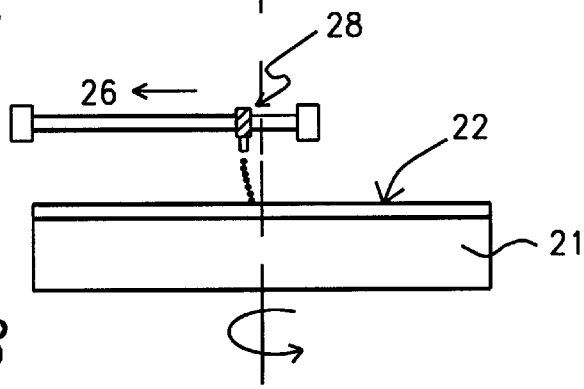
FIG. 3
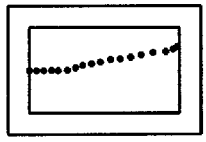
FIG. 4

IN-SITE ROLLER DRESSER

BACKGROUND OF THE INVENTION (1) Field of the Invention

The present invention relates to the field of Chemical Mechanical Polishing (CMP). More particularly, the present invention relates to methods and apparatus for chemical mechanical polishing of substrates, such as semiconductor substrates, on a rotating polishing pad in the presence of chemically and/or physically abrasive slurry. The present invention provides a pad profile conditioning apparatus to condition the polishing pad while the polishing pad is being used to polish semiconductor substrates.

(2) Description of the Prior Art

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials therein, is maintained on the polishing pad to modify the polishing characteristics of the polishing pad in order to enhance the polishing of the substrate.

The use of chemical mechanical polishing to planarize semiconductor substrates has not met with universal acceptance, particularly where the process is used to remove high elevation features created during the fabrication of microelectronic circuitry on the substrate. One primary problem which has limited the used of chemical mechanical polishing in the semiconductor industry is the limited ability to predict, much less control, the rate and uniformity at which the process will remove material from the substrate. As a result, CMP is a labor intensive process because the thickness and uniformity of the substrate must be constantly monitored to prevent overpolishing or inconsistent polishing of the substrate surface.

The profile of the polishing pad plays an important role in determining good overall polishing results. The polishing pad can, for instance, be profiled thick at the inner diameter of the polishing pad as compared to the outer diameter of the polishing pad and visa versa. The profile of the polishing pad is typically achieved by trial and error and by adjusting the position of a diamond dresser (see following paragraph). This method of profiling the polishing pad is destructive, time consuming and causes the loss of the polishing pad. Since this measure of the polishing pad profile can only be performed at the end of the useful life of the polishing pad, the wrong profile can only be detected after the polishing pad has served its useful life.

The function of the diamond dresser is to maintain and/or restore the polishing characteristics of the polishing pad to the maximum extent possible during the polishing operation and in doing so to extend the useful life or the operating characteristics of the polishing pad. The diamond dresser performs this function by influencing the polishing action of the polishing pad during its operation. This influencing can take the form of exerting pressure on the polishing pad and in so doing influencing the polishing characteristics of the polishing pad.

The polishing process is carried out until the surface of the wafer is ground to a highly planar state. During the polishing process, both the wafer surface and the polishing pad become abraded. After numerous wafers have been polished, the polishing pad becomes worn to the point where the efficiency of the polishing process is diminished and the rate of removal of material from the wafer surface is significantly decreased. It is usually at this point that the polishing pad is treated and restored to its initial state so that a high rate of uniform polishing can once again be obtained.

FIG. 1 shows a Prior Art CMP apparatus. A polishing pad 20 is affixed to a circular polishing table 22 that rotates in a direction indicated by arrow 24 at a rate in the order of 1 to 100 RPM. A wafer carrier 26 is used to hold wafer 18 face down against the polishing pad 20. The wafer 18 is held in place by applying a vacuum to the backside of the wafer (not shown). The wafer 18 can also be attached to the wafer carrier 26 by the application of a substrate attachment film (not shown) to the lower surface of the wafer carrier 26. The wafer carrier 26 also rotates as indicated by arrow 32, usually in the same direction as the polishing table 22, at a rate on the order of 1 to 100 RPM. Due to the rotation of the polishing table 22, the wafer 18 traverses a circular polishing path over the polishing pad 20. A force 28 is also applied in the downward vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26.

Accordingly, the subject surface (that is the lower surface) of the substrate 18 is polished by the combination of a chemical polishing action of alkali contained in the polishing agent or slurry 21 and a mechanical polishing action by silica contained in the polishing slurry 21.

U.S. Pat. No. 5,775,983 (Shendon et al.) shows a conical roller for conditioning a pad.

U.S. Pat. No. 5,779,526 (Gill) show a polishing pad conditioning roller.

U.S. Pat. No. 5,681,212 (Hayakawa) shows a disk dresser.

U.S. Pat. No. 5,421,768 (Fijiwara et al.) shows a brush to clean a polishing pad.

U.S. Pat. No. 5,688,360 (Jairath) shows cylindrical and conical polishing pads.

SUMMARY OF THE INVENTION

It is therefore the primary objective of the present invention to provide a polishing device that can realize a high semiconductor wafer throughput and that exhibits uniformity and planarity or evenness of surface in the plane of the surface of the substrate that is to be polished.

The in-site roller dresser that is the subject of the present invention allows for the profile of the pad to be monitored while the roller is dressed or refurbished. This eliminates the need for destructive testing of the polishing pad. The in-site roller dresser at the same time eliminates the need for machine downtime for polishing pad profile determination since the polishing pad profile is dynamically tested and monitored during polishing operations. In conventional arrangements, the dresser is a disk, in the arrangement of the present invention the dresser is a roller type that can rotate around its axis in either direction. A sensor is provided with the diamond dresser that monitors the surface or profile of the polishing pad. Based on the data obtained by the sensor, the diamond dresser can be adjusted, which directly controls the polishing pad refurbishing action provided by the dresser.

In the first embodiment of the present invention the in-site roller dresser is manually controlled and adjusted for desired polishing pad profile and in accordance with a visually observed profile of the polishing pad as observed via an electronic display.

In the second embodiment of the present invention the in-site roller dresser is automatically controlled and adjusted for desired polishing pad profile. This adjustment is in accordance with a desired and predetermined polishing pad profile that is contained within the controlling mechanism of the polishing pad dresser.

BRIEF DESCRIPTION OF THE DRAWINGS

FIG. 1 shows a Prior Art polishing pad apparatus.

FIG. 2 shows an overview of the mounting of the present invention diamond dresser with respect to the polishing pad and the polishing table.

FIG. 3 shows the mounting of the sensor of the present invention with respect to the polishing pad and the polishing table.

FIG. 4 shows the profile of a polishing pad as can be obtained within the scope of the present invention.

DETAILED DESCRIPTION OF THE PREFERRED EMBODIMENT

Referring now more specifically to FIG. 2, there is shown a rotating around its axis 27 that is mounted in a suspended manner and in such a manner that the diamond dresser 20 is above the polishing pad 22 and can be brought into physical contact with polishing pad 22. Polishing pad 22 is mounted on top of the polishing table 21. The mounting or suspension of dresser 20 is such that either of the two extremities of the dresser 20 can move in the Z direction, that is the direction perpendicular to the plane of the polishing pad 22. This movement or rotation is indicated by rotations 16 and 18. The two forces 12 and 14 that are exerted in the Z direction cause this movement. The circular polishing table 21 rotates around its axis 23 in a direction indicated by arrow 25 at a rate in the order of 1 to 100 RPM.

It must be noted at this time that the operation of the diamond dresser 20 is an operation that may or may not take place concurrent with the polishing action of the polishing pad. The action of the diamond dresser is invoked at the time that it is considered necessary to refurbish or 'dress' the polishing pad. That is the profile of the polishing pad must, after the pad has been used for a period of time, be restored to a new or corrected profile that is required for further and continued polishing operation.

FIG. 3 shows the mounting of the sensor 28 with respect to the polishing pad 22 and the polishing table 21. The sensor 28 slides along the sensor guide 35 in a plane that is parallel with the plane of the surface of polishing pad 22. The sensor 28 can be of a variety of types, for instance a capacitive sensor. The sensor position can be varied in a direction 26, that is parallel to the polishing pad 22. This motion 26 enables the sensor 28 to measure or track the profile of the polishing pad 22 across the entire surface of the polishing pad 22. These measurements provide a direct feedback of the condition of the profile or surface condition of the polishing pad 22. By increasing force 12 (FIG. 2) with respect to force 14 (FIG. 2), the diamond dresser 20 will exert more pressure on the polishing pad in the center of the polishing pad 22. Inversely, by increasing the pressure of force 14 (FIG. 2) with respect to force 12 (FIG. 2), the diamond dresser 20 will exert more pressure on the polishing pad 22 in the periphery or outer edges of the polishing pad 22. It is thus clear that the diamond dresser 20 has direct control over the shaping of the profile or top surface of the polishing pad 22 in a closed loop control system.

The parameters required to determine the position of the sensor 28 above the polishing pad 22 are the angle of rotation of the polishing pad 22 combined with the position of the movement 26 of the detector 28 along its axis of motion. Since the measurements obtained by the sensor 28 are a direct indication of the profile or top surface of the polishing pad 22 and since this information can be compared directly with a desired profile or top surface of the polishing pad, it is apparent that the information which directs forces 12 and 14 in FIG. 2 is available which in turn allows for either manual or automatic control or adjustment of the profile or top surface of the polishing pad 22.

FIG. 4 shows how the profile can be displayed and monitored by using an electronic display or monitor. This does allow for human intervention and adjustment. This human intervention however is not in conflict with a completely automatic control system of the profile 29 of the polishing pad where measured (by the sensor) data is compared with stored or required profile data. The adjustment parameters, if any, can automatically adjust the two polishing pad profile control parameters 12 and 14 of FIG. 2.

From the foregoing it will be clear that, although a specific embodiment of the present invention has been described herein for purposes of illustration, various modifications to the present invention may be made without deviating from the spirit and scope of the present invention. Accordingly, the present invention is not limited except as by the appended claims.

What is claimed is:

1. An apparatus for chemical mechanical polishing of semiconductor wafers, comprising:

a platform for mounting semiconductor wafers;

a means for rotating said platform for mounting semiconductor wafers;

a semiconductor wafer polishing pad whereby said polishing pad is circular in shape and has a geometric center and a polishing surface whereby said polishing surface has a profile said polishing surface being in a polishing plane whereby furthermore said polishing pad has an edge of periphery;

a platform for mounting said semiconductor wafer polishing pad;

a means for rotating said platform for mounting said semiconductor wafer polishing pad;

a means for measuring the profile of said semiconductor wafer polishing pad said means being a sensor, said sensor being mounted on a cylindrical sensor axis along which said sensor can be moved in a longitudinal direction of said axis and in a plane that is parallel to said polishing plane of said polishing surface, whereby said sensor can be positioned such that said sensor measures all points contained within the polishing surface of said polishing pad, wherein said sensor comprises an electro-mechanical device that can provide measurements of polishing pad profile combined with data of sensor position within the profile of said polishing surface such that a presentation of a complete and accurate profile of said polishing surface is obtained, whereby based on the data obtained by the sensor the diamond dresser can be adjusted which directly controls the polishing pad refurbishing action provided by the dresser;

a cylindrical diamond dresser for refurbishing said semiconductor wafer polishing pad whereby said cylindrical diamond dresser has dressing characteristics whereby said cylindrical diamond dresser is mounted on an axis having a direction whereby said axis furthermore has two extremities whereby said cylindrical diamond dresser has a longitudinal geometric axis that coincides with said axis on which said cylindrical diamond dresser is mounted whereby said cylindrical diamond dresser further has a longitudinal dimension with longitudinal extremities further having a geometric center which is located on said longitudinal geometric axis of said cylindrical diamond dresser halfway between said longitudinal extremities of said cylindrical diamond dresser whereby said cylindrical diamond dresser can be activated by exerting a downward force on either one or both of said extremities of said axis on which said cylindrical diamond dresser is mounted and in a direction that is perpendicular to said polishing surface of said polishing pad whereby said cylindrical dresser is considered inactivated when no force is exerted on said axis on which said cylindrical diamond dresser is mounted;

a means for rotating said cylindrical diamond dresser by rotating said axis on which said cylindrical diamond dresser is mounted;

a means for evenly distributing slurry across the surface of said polishing pad; and a means for controlling said downward force that can be exerted on said axis on which said cylindrical diamond dresser in mounted.

2. The apparatus of claim 1 wherein said platform for mounting semiconductor wafers comprises a wafer carrier table.

3. The apparatus of claim 1 wherein said means for rotating said platform for mounting semiconductor wafers comprises a rotary actuator or motor.

4. The apparatus of claim 1 wherein said platform for mounting said semiconductor wafer polishing pad comprises a polishing table.

5. The apparatus of claim 1 wherein the means for rotating said platform for mounting said semiconductor wafer polishing pad comprises a rotary actuator or motor.

6. The apparatus of claim 1 wherein said cylindrical diamond dresser has a surface that is mounted in a suspended manner above and in close physical proximity to said semiconductor wafer polishing pad where the direction of the axis on which said cylindrical diamond dresser is mounted when in said inactivated position is parallel to the polishing surface of said polishing pad and where the dressing characteristics of said cylindrical diamond dresser are not uniform along the surface of said cylindrical diamond dresser in the direction of the axis on which said cylindrical diamond dresser is mounted.

7. The apparatus of claim 6 where said dressing characteristics of said cylindrical diamond dresser are not uniform along the surface of said cylindrical diamond dresser and have a linear gradient of dressing efficiency with the highest dressing action occurring at one longitudinal extremity of said cylindrical diamond dresser from where the dressing action linearly decreases toward the opposing longitudinal extremity of said cylindrical diamond dresser.

8. The apparatus of claim 6 where said dressing characteristics of said cylindrical diamond dresser are not uniform along the surface of said cylindrical diamond dresser and have a linear gradient of dressing efficiency with the highest dressing action occurring at the periphery or edge of said polishing pad from where the dressing action linearly decreases toward the geometric center of said polishing pad.

9. The apparatus of claim 6 where the dressing characteristics of said cylindrical diamond dresser are not uniform along the surface of said cylindrical diamond dresser and have an exponential gradient of dressing efficiency with the highest dressing action occurring at the geometric center of said polishing pad from where the dressing action exponentially decreases toward the periphery or edge of said polishing pad.

10. The apparatus of claim 6 where the dressing characteristics of the cylindrical diamond dresser are not uniform along the surface of said cylindrical diamond dresser and have an exponential gradient of dressing efficiency with the highest dressing action occurring at the periphery or edge of said polishing pad from where the dressing action exponentially decreases toward the center of said polishing pad.

11. The apparatus of claim 6 where said dressing characteristics of said cylindrical diamond dresser are not uniform along the surface of said cylindrical diamond dresser and are profiled or graded to have a dressing efficiency with highest dressing action occurring at the center of said polishing pad from where dressing action decreases in accordance with a polishing profile of said cylindrical diamond dresser toward the periphery or edge of said polishing pad.

12. The apparatus of claim 6 where the dressing characteristics of said cylindrical diamond dresser are not uniform along the surface of said cylindrical diamond dresser and are profiled or graded to have a dressing efficiency with lowest dressing action occurring at the center of said polishing pad from where dressing action increases in accordance with a dressing profile of said cylindrical diamond dresser toward the periphery or edge of said polishing pad.

13. The apparatus of claim 1 where said means for controlling said downward force comprises manual control of said downward force exerted on either one or both of the two extremities of said axis on which said cylindrical diamond dresser is mounted.

14. The apparatus of claim 1 where said means for controlling said downward force comprises an automatic closed loop control system of said downward force exerted on either one or both of said two extremities of said axis on which said cylindrical diamond dresser is mounted.

15. The apparatus of claim 1 where said means for controlling said downward force comprises manual control of forces exerted at said two extremities of said cylindrical diamond dresser which can be preempted by an automatic, closed loop control system of said forces exerted on said two extremities of said axis on which said cylindrical diamond dresser is mounted.

16. The apparatus of claim 1 where said means for controlling the downward force comprises a closed loop control system for control of said forces exerted at said two extremities of said cylindrical diamond dresser which can be preempted by manual control of said forces exerted on said two extremities of said axis on which said cylindrical diamond dresser is mounted.

17. The apparatus of claim 1 wherein the means for rotating said cylindrical diamond dresser comprises a rotary activator or motor.

18. The apparatus of claim 1 wherein said means for evenly distributing slurry across the surface of said polishing pad is using a slurry drip process.

19. A method for chemical mechanical polishing of semiconductor wafers, comprising:

providing a platform for mounting semiconductor wafers;

providing a means for rotating said platform for mounting semiconductor wafers;

providing a semiconductor wafer polishing pad whereby said polishing pad is circular in shape and has a geometric center and a polishing surface whereby said polishing surface has a profile said polishing surface being in a polishing plane whereby furthermore said polishing pad has an edge of periphery;

providing a platform for mounting said semiconductor wafer polishing pad;

providing a means for rotating said platform for mounting said semiconductor wafer polishing pad;

providing a means for measuring the profile of said semiconductor wafer polishing pad said means being a sensor, whereby said sensor is mounted on a cylindrical sensor axis along which said sensor can be moved in a longitudinal direction of said axis and in a plane that is parallel to said polishing plane of said polishing surface, whereby said sensor can be positioned such that said sensor measures all points contained within the polishing surface of said polishing pad, whereby said sensor comprises an electro-mechanical device that can provide measurements of polishing pad profile combined with data of sensor position within the profile of said polishing surface such that a presentation of a complete and accurate profile of said polishing surface is obtained, whereby based on the data obtained by the sensor the diamond dresser can be adjusted which directly controls the polishing pad refurbishing action provided by the dresser;

providing a cylindrical diamond dresser for refurbishing said semiconductor wafer polishing pad whereby said cylindrical diamond dresser has dressing characteristics whereby said cylindrical diamond dresser is mounted on an axis having a direction whereby said axis furthermore has two extremities whereby said cylindrical diamond dresser has a longitudinal geometric axis that coincides with said axis on which said cylindrical diamond dresser is mounted whereby said cylindrical diamond dresser further has a longitudinal dimension with longitudinal extremities further having a geometric center which is located on said longitudinal geometric axis of said cylindrical diamond dresser halfway between said longitudinal extremities of said cylindrical diamond dresser whereby said cylindrical diamond dresser can be activated by exerting a downward force on either one or both of said extremities of said axis on which said cylindrical diamond dresser is mounted and in a direction that is perpendicular to said polishing surface of said polishing pad whereby said cylindrical dresser is considered inactivated when no force is exerted on said axis on which said cylindrical diamond dresser is mounted;

providing a means for rotating said cylindrical diamond dresser by rotating said axis on which said cylindrical diamond dresser is mounted;

providing a means for evenly distributing slurry across the surface of said polishing pad; and providing a means for controlling said downward force that can be exerted on said axis on which said cylindrical diamond dresser in mounted.

20. The method of claim 19 wherein said platform for mounting semiconductor wafers comprises a wafer carrier table.

21. The method of claim 19 wherein said means for rotating said platform for mounting semiconductor wafers comprises a rotary actuator or motor.

22. The method of claim 19 wherein said platform for mounting said semiconductor wafer polishing pad comprises a polishing table.

23. The method of claim 19 wherein the means for rotating said platform for mounting said semiconductor wafer polishing pad comprises a rotary actuator or motor.

24. The method of claim 19 wherein said cylindrical diamond dresser has a surface that is mounted in a suspended manner above and in close physical proximity to said semiconductor wafer polishing pad where the direction of the axis on which said cylindrical diamond dresser is mounted when in said inactivated position is parallel to the polishing surface of said polishing pad and where the dressing characteristics of said cylindrical diamond dresser are uniform along the surface of said cylindrical diamond dresser in the direction of the axis on which said cylindrical diamond dresser is mounted.

25. The method of claim 19 where said dressing characteristics of said cylindrical diamond dresser are not uniform along the surface of said cylindrical diamond dresser and have a linear gradient of dressing efficiency with the highest dressing action occurring at one longitudinal extremity of said cylindrical diamond dresser from where the dressing action linearly decreases toward the opposing longitudinal extremity of said cylindrical diamond dresser.

26. The method of claim 19 where said dressing characteristics of said cylindrical diamond dresser are not uniform along the surface of said cylindrical diamond dresser and have a linear gradient of dressing efficiency with the highest dressing action occurring at the periphery or edge of said polishing pad from where the dressing action linearly decreases toward the geometric center of said polishing pad.

27. The method of claim 19 where the dressing characteristics of said cylindrical diamond dresser are not uniform along the surface of said cylindrical diamond dresser and have an exponential gradient of dressing efficiency with the highest dressing action occurring at the geometric center of said polishing pad from where the dressing action exponentially decreases toward the periphery or edge of said polishing pad.

28. The method of claim 19 where the dressing characteristics of the cylindrical diamond dresser are not uniform along the surface of said cylindrical diamond dresser and have an exponential gradient of dressing efficiency with the highest dressing action occurring at the periphery or edge of said polishing pad from where the dressing action exponentially decreases toward the center of said polishing pad.

29. The method of claim 19 where said dressing characteristics of said cylindrical diamond dresser are not uniform along the surface of said cylindrical diamond dresser and are profiled or graded to have a dressing efficiency with highest dressing action occurring at the center of said polishing pad from where dressing action decreases in accordance with a polishing profile of said cylindrical diamond dresser toward the periphery or edge of said polishing pad.

30. The method of claim 19 where the dressing characteristics of said cylindrical diamond dresser are not uniform along the surface of said cylindrical diamond dresser and are profiled or graded to have a dressing efficiency with lowest dressing action occurring at the center of said polishing pad from where dressing action increases in accordance with a dressing profile of said cylindrical diamond dresser toward the periphery or edge of said polishing pad.

31. The method of claim 19 where said means for controlling said downward force comprises manual control of said downward force exerted on either one or both of the two extremities of said axis on which said cylindrical diamond dresser is mounted.

32. The method of claim 19 where said means for controlling said downward force comprises an automatic closed loop control system of said downward force exerted on either one or both of said two extremities of said axis on which said cylindrical diamond dresser is mounted.

33. The method of claim 19 where said means for controlling said downward force comprises manual control of forces exerted at said two extremities of said cylindrical diamond dresser which can be preempted by an automatic, closed loop control system of said forces exerted on said two extremities of said axis on which said cylindrical diamond dresser is mounted.

34. The method of claim 19 where said means for controlling the downward force comprises a closed loop control system for control of said forces exerted at said two extremities of said cylindrical diamond dresser which can be preempted by manual control of said forces exerted on said two extremities of said axis on which said cylindrical diamond dresser is mounted.

35. The method of claim 19 wherein the means for rotating said cylindrical diamond dresser comprises a rotary activator or motor.

36. The method of claim 19 wherein said means for evenly distributing slurry across the surface of said polishing pad is using a slurry drip process.

* * * * *